US008322331B2

(12) United States Patent
Swanson

(10) Patent No.: US 8,322,331 B2
(45) Date of Patent: Dec. 4, 2012

(54) BURNER FOR COMBUSTION OF FUEL IN PELLET OR GRANULAR FORM

(76) Inventor: Harold Angus Swanson, Pictou (CA)

( * ) Notice: Subject to any disclaimer, the term of this patent is extended or adjusted under 35 U.S.C. 154(b) by 556 days.

(21) Appl. No.: 12/454,278

(22) Filed: May 14, 2009

(65) Prior Publication Data

US 2010/0126491 A1 May 27, 2010

(30) Foreign Application Priority Data

Nov. 25, 2008 (CA) ..... 2644734

(51) Int. Cl.
*F23H 13/00* (2006.01)

(52) U.S. Cl. ..... 126/152 B; 126/152 R; 126/182; 126/554

(58) Field of Classification Search ..... 126/112, 126/144, 146, 150, 148, 155, 159, 160, 161, 126/163 R, 170, 172, 173, 181, 182, 357.1, 126/501, 516, 523, 532, 540, 541, 542, 543, 126/167, 537, 152 B, 152 R, 554; 110/248, 110/258, 259, 287, 165 R, 170, 115
See application file for complete search history.

(56) References Cited

U.S. PATENT DOCUMENTS

| | | | | |
|---|---|---|---|---|
| 2,402,436 | A * | 6/1946 | Nichols | 110/247 |
| 3,824,935 | A * | 7/1974 | Yamato et al. | 110/258 |
| 4,583,992 | A * | 4/1986 | Rogers | 48/76 |
| 4,947,769 | A * | 8/1990 | Whitfield | 110/259 |
| 5,001,993 | A * | 3/1991 | Gramlow | 110/233 |
| 5,285,738 | A * | 2/1994 | Cullen | 110/233 |
| 5,893,358 | A | 4/1999 | Whitfield | |
| 6,336,449 | B1 | 1/2002 | Drisdelle et al. | |
| 2002/0083944 | A1 * | 7/2002 | Darbonne, Sr. | 126/501 |
| 2007/0125282 | A1 | 6/2007 | Varagani | |

* cited by examiner

*Primary Examiner* — Kenneth Rinehart
*Assistant Examiner* — Jorge Pereiro
(74) *Attorney, Agent, or Firm* — Frank J. Bonini, Jr.; John F. A. Earley, III; Harding, Earley, Follmer & Frailey, P.C.

(57) ABSTRACT

A burner for fuel in pellet or granular form in which the fuel has a high ash content, for example grass or hay pellets in which the ash content is 5% or more. The burner has a combustion chamber with a grate at its lower end, into which fuel and air are fed, the combustion chamber having a hot gas outlet for exhausting combustion gases. The grate is provided with a rotary member having upstanding vanes which is adapted to continually move ash or clinker on the grate through outlet apertures spaced around the grate. The grate is a generally planar, horizontal surface which is imperforate apart from the outlet apertures; air inlet ports are arranged in a circumferential wall surrounding the grate.

9 Claims, 5 Drawing Sheets

BURNER FOR COMBUSTION OF FUEL IN PELLET OR GRANULAR FORM

BACKGROUND OF THE INVENTION

1. Field of the Invention

The present invention relates to a burner for combustion of fuel in pellet or granular form, and may be referred to as a "pellet burner" or "pellet furnace". The invention is especially designed to operate with pellet or granular fuel of high ash content, for example grass or hay pellets. While the invention is particularly described in relation to a water heater or boiler, the invention may equally be applied to other combustion devices, e.g. a stove or space heater.

2. Prior Art

Pellet burners are known both for space heating and water heating. Usually, the pellets used are formed from wood, e.g. sawdust, and have an ash content usually less than 1%. When such pellets are burnt the ash is very light, and the combustion air fed to the burner, which is usually forced air provided by a fan, blows the ashes out of the top of the combustion chamber through a chimney.

It would be desirable to use pellets from other sources, e.g. made from plant material which is otherwise waste. Such materials however usually have an ash content of over 1%. For example, grass or hay pellets usually have over 5% ash content, and may be contaminated with sand and potassium chloride which produce glassy materials, in the form of clinkers or slag, when it burns. Such combustion products, which are usually heavier than the light hay or grass pellets, build up on a conventional burner grate and may put out the fire after a few hours. The ashes would have to be cleaned out too often for such operation to be practical.

It has been proposed, for example in U.S. Pat. No. 6,336,449 to Drisdelle et al., to make a pellet burner with a special combustion chamber, and restricted air supply, and it is claimed that this burner is capable of efficiently burning fuel containing 10% ash without the formation of slag and clinkers. This patent also suggests the use of a special grate; this has no moving parts.

U.S. Pat. No. 5,893,358 and U.S. Patent Application No. 2007/0125282 both show pellet burners in which clinkers or slag are periodically removed by reciprocating means associated with the grate.

SUMMARY OF THE INVENTION

The present invention provides a pellet burner capable of burning fuel containing at least 5%, and in some cases up to 7% of ash, including grasses, without the grate becoming clogged with clinkers or slag.

In accordance with the present invention, a burner for fuel in pellet or granular form comprises, a combustion chamber having a grate at its lower end; means for feeding the fuel into the combustion chamber; means for supplying air to the combustion chamber; a hot gas outlet for combustion gases from the combustion chamber; and means for transferring heat from the combustion chamber and/or said hot gas outlet to air or other fluid to be heated; wherein the grate is provided with a rotary member adapted to continually move ash or clinker on said grate through outlet apertures spaced around said grate.

The term "grate" is used in the sense of a surface which holds the burning fuel, and does not imply that this has openings for combustion air as is usual with grates. In fact, the grate of this invention may be unperforated except for the outlet apertures, and the combustion air enters the combustion chamber through air inlets spaced around a lower part of the combustion chamber which is termed the "burn pot", these air inlets being above the level of the grate.

Preferably, the grate includes a generally planar surface provided with recesses over which the rotary member passes, the rotary member and recesses being such that ash or clinker particles may be broken into smaller particles by engagement of said particles in said recesses as the rotary member passes over the recesses and fragments the particles.

The planar surface of the grate is usually horizontal, and the rotary member rotates on a vertical shaft. The grate is preferably surrounded by a cylindrical wall which defines the burn pot, and the outlet apertures of the grate are spaced around outer edges of the grate near the cylindrical wall. The rotary member may include a generally horizontal bar mounted on a vertical shaft, and vanes projecting upwardly from an upper surface of the bar and angled to the bar in such way as to move ash outwardly towards the outlet apertures as the bar rotates.

The cylindrical wall of the burn pot may be provided with a spring-biased door through which large ash or clinker particles can be expelled by the rotary member. The vertical shaft may be rotated by a horizontal-axis motor via a bevel gear.

BRIEF DESCRIPTION OF THE DRAWINGS

Preferred embodiments of the invention will now be described by way of example with reference to the accompanying drawings, in which.

DETAILED DESCRIPTION OF THE PREFERRED EMBODIMENT

Figure 1:
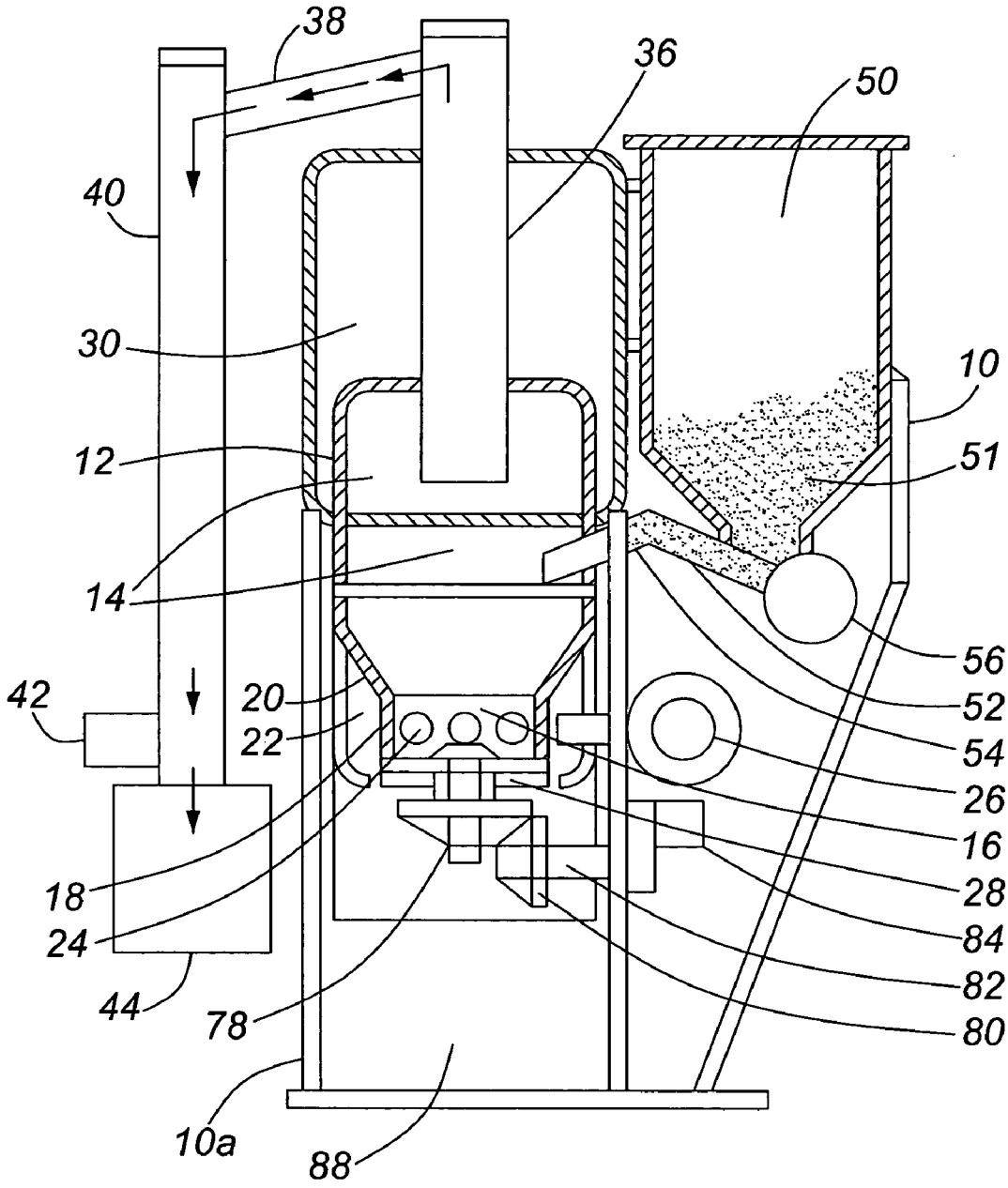
FIG. 1 is a longitudinal sectional elevation through a burner in accordance with the invention.
Figure 2:
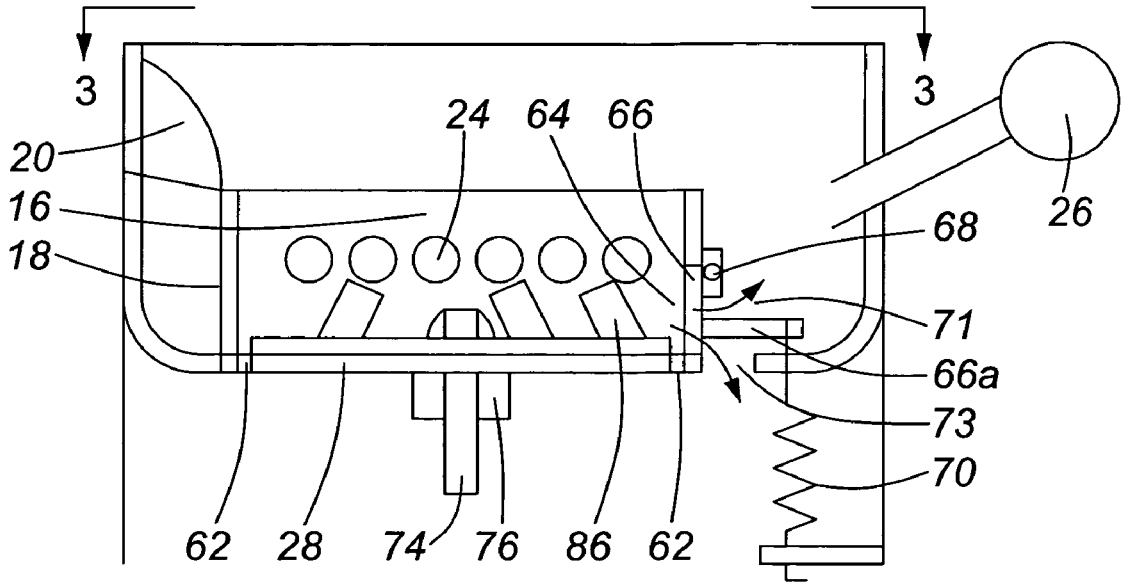
FIG. 2 is an enlarged sectional elevation through the lower part of the combustion chamber of the burner.
Figure 3:
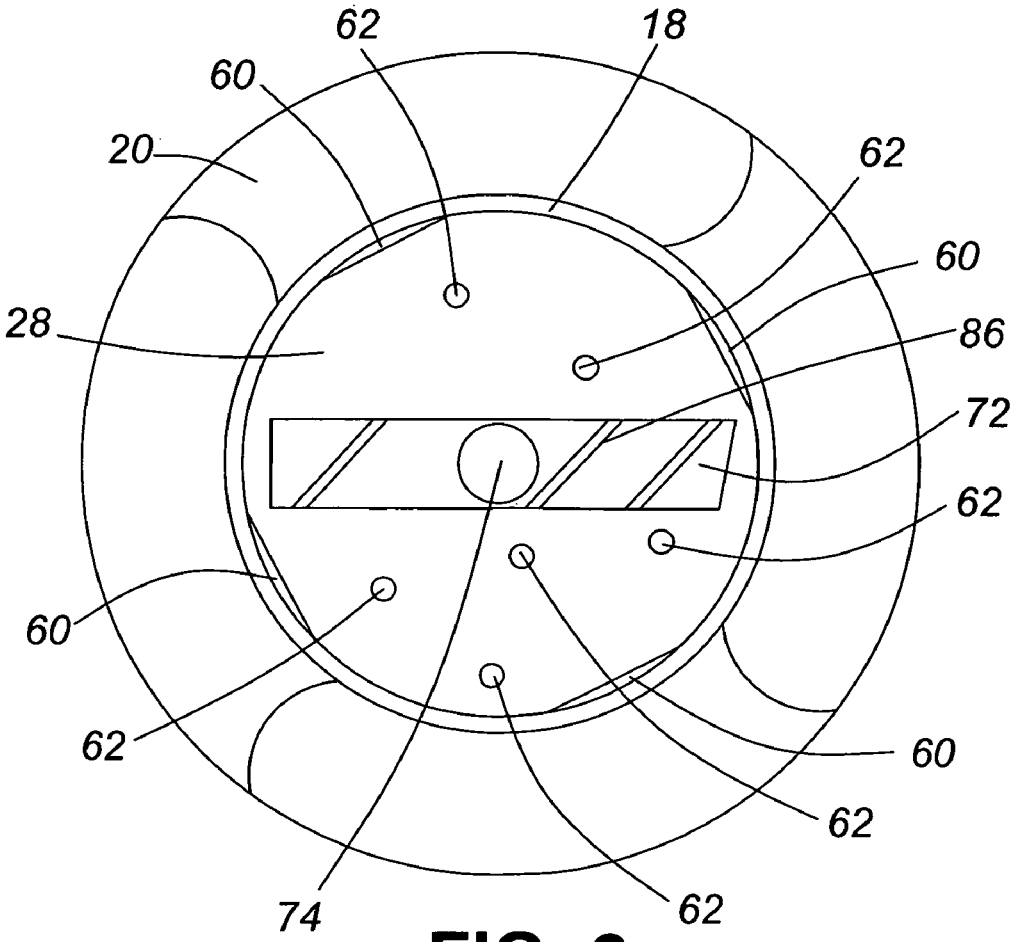
FIG. 3 is a plan view of the lower part of the combustion chamber taken on lines 3-3 of FIG. 2.

Referring to FIGS. 1 to 3, the pellet burner, which is in the form of a water heater, has a support frame 10, including a central part with legs 10*a* which support a casing 12 surrounding a combustion chamber 14. The lower part of chamber 14 is in the form of a burn pot 16 having a cylindrical wall 18 of reduced diameter compared to the upper part of chamber 14. Wall 18 is connected to the upper part of the combustion chamber 14 by an upwardly diverging wall portion 20 which forms the top of an annular inlet air chamber 22, which chamber communicates with the burn pot 16 via air inlet ports 24 spaced around the wall 18. Annular chamber 22 receives forced air for combustion from an air blower 26. The bottom of the burn pot 16 is formed by a grate 28, having a special ash removal mechanism described below.

This embodiment of burner being in the form of a water heater, an upper portion of the combustion chamber 14 is surrounded by a lower part of a water chamber 30. A chimney 36 leading upwardly from the combustion chamber 14 passes up through the center of an upper part of the water chamber 30 and conducts hot flue gases out of the combustion chamber while heating the water in chamber 30. The flue gases then pass through a radial pipe 38 and then down a downpipe 40, at the bottom of which the flue gases pass out of a side outlet 42, while fly ash is collected in collector pot 44.

The burner also includes a pellet hopper 50, the lower end of which feeds pellets 51 into an auger 52 which delivers the pellets via a pipe 54 into a central area of the combustion chamber 14, the auger being driven by motor 56, these parts being generally conventional.

FIGS. 2 and 3 show details of the burner pot 16 and the associated grate 28, these parts being central features of this invention. As shown in these drawings, the grate 28 at the base of the burn pot is a generally planar and generally circular plate fixed to the base of the cylindrical wall 18 around most of its circumference, but provided with four narrow, circumferentially extending apertures 60 located at points where the edges of the plate 28 are cut away and do not meet the wall 18. Also, the annular plate 28 is provided with a number (about 6 or 8) recesses in the form of circular holes 62 which are blind, i.e. do not extend through the thickness of the plate.

The lower part of wall 18 is also provided with a larger, side outlet 64 normally closed by a door 66 pivoted at its upper edge by pivots 68, and urged into the closed position (as illustrated in FIG. 2) by a tension spring 70 acting on a radial extension 66a of the door. This allows removal of clinkers as described below.

Immediately above the plate 28 is a bar 72 in the form of an elongated horizontal plate having a flat lower surface overlying the plate and extending out to the apertures 60. The bar 72 is fixed to a vertical shaft 74 extending upwardly through a bore in the center of the grate and supported by a bearing 76 attached to the lower surface of the grate. The lower end of shaft 74 is fixed to a first bevel gear 78 which meshes with a second bevel gear 80 fixed to a horizontal shaft 82 driven by a low r.p.m. geared electric motor 84 mounted on the outer side of one of the legs 10*a*.

As shown in FIGS. 2 and 3, the upper surface of the bar 72 is provided with several, for example three, upstanding vanes 86 which (as seen in FIG. 3) lie at an angle of about 30 to 45° to the circumferential direction of movement of the respective vane. The vanes also lie at an angle of about 25 to 30° to the vertical, as seen in FIG. 2. The vanes are angled so that as the bar 72 rotates in a clockwise direction, as seen in FIG. 3, the vanes push outwardly the ash which has collected on the grate, eventually causing at least some of this ash to drop through the apertures 60 into an ash pan 88, shown in FIG. 1, below the grate. The grass or hay pellets, which are relatively light compared to wood pellets, burn while floating on top of the ash, so that few of the unburnt pellets are expelled with the ash.

Some of the ash particles, e.g. clinkers, may be too large to fall through the apertures 60. Some of these will be moved around the grate by bar 72 and fall into one of the recesses 62, whereupon continued movement of the bar 72 breaks off parts of any of such particle lying above the upper surface of the grate. This fragments the particles so that most of them can later drop through the apertures 60. In addition, even larger pieces of slag or clinker, which may be too large to be held by recesses 62, can be pushed by the vanes 86 radially out of the spring biased door 66 (the door being openable in the direction illustrated by the arrow 71), the spring 70 yielding to the radial force provided by the bar 72. This mechanism prevents undue accumulation of ash or clinkers on the grate, such as would interfere with air being admitted through air inlet ports 24. The slag, clinker and ash pushed through the opened door 66 falls (as illustrated by the arrow 73) into the ash pan 88 for subsequent removal and disposal.

Figure 4:
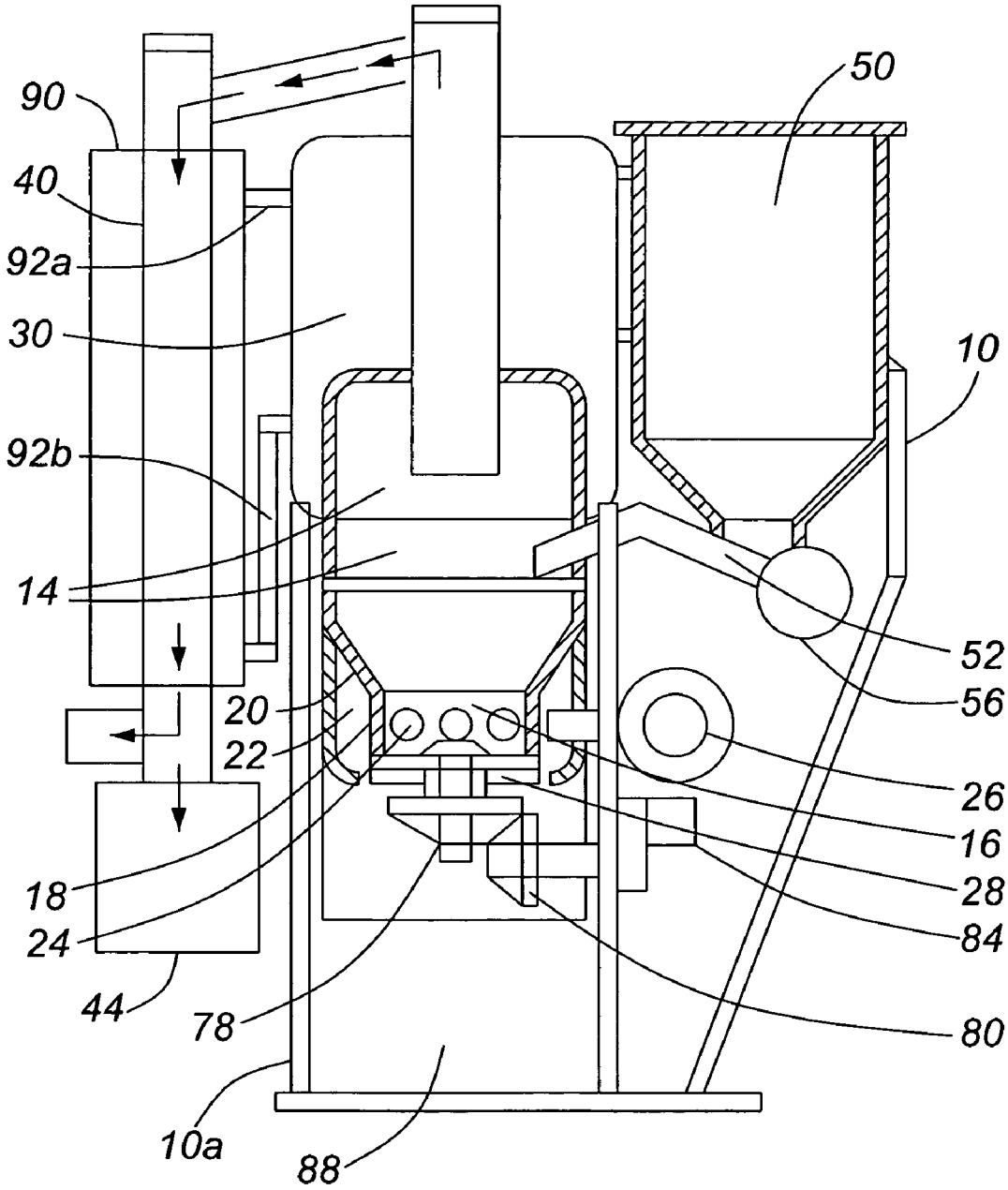
FIG. 4 is a view similar to FIG. 1 of a modified burner.

FIG. 4 shows a modified version of the first embodiment having an additional heat exchanger 90 in the form of a water jacket surrounding the down pipe 40 and connected to the upper and lower portions of the water chamber 30 by upper and lower water tubes 92*a* and 92*b* respectively. This improves efficiency by transferring additional heat from the chimney into the water.

Figure 5:
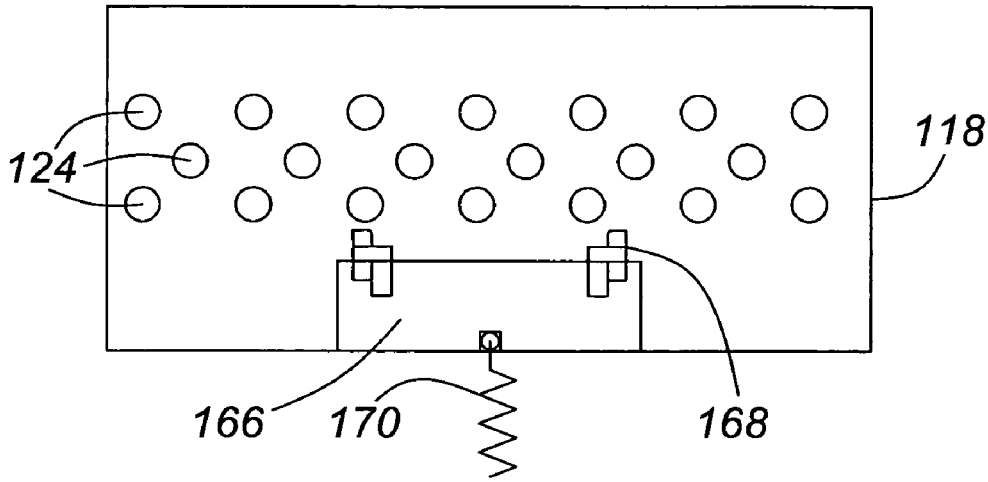
FIG. 5 is a view similar to FIG. 2 of the bottom portion of a slightly modified combustion chamber.
Figure 6:
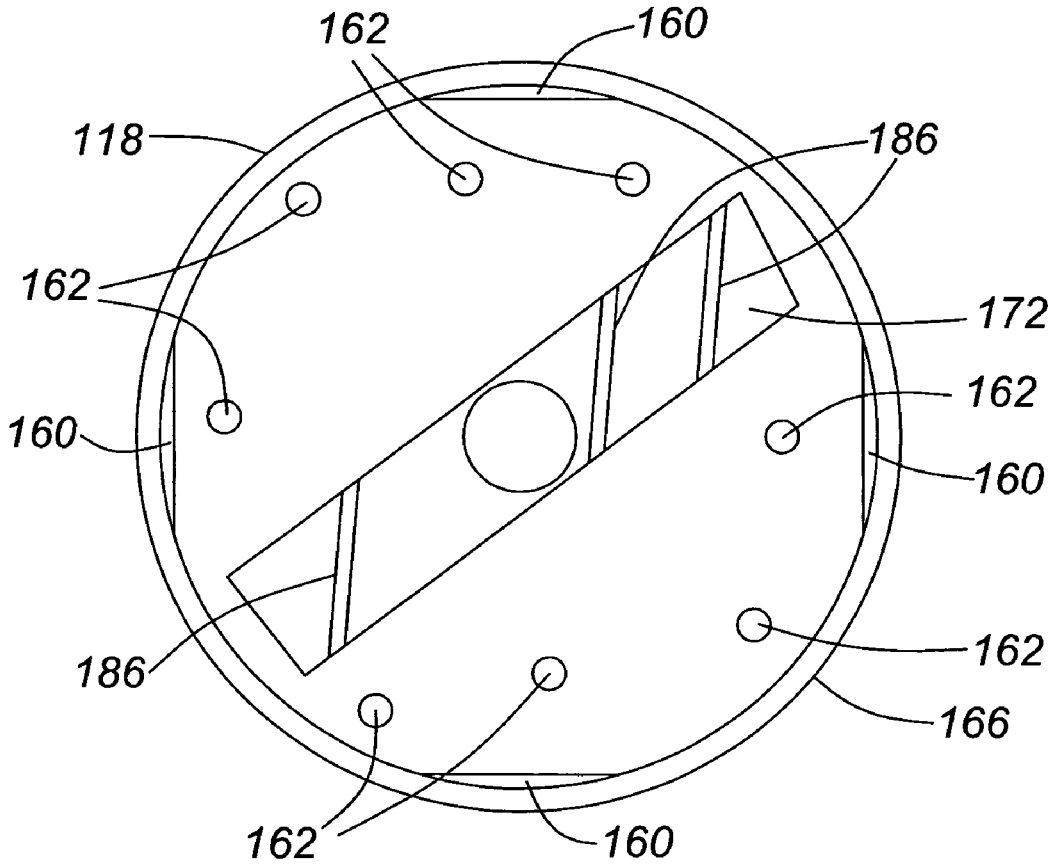
FIG. 6 is a plan view of the combustion chamber part of FIG. 5.

FIGS. 5 and 6 are views showing parts similar to those shown in FIGS. 2 and 3, and the similar parts are shown by the same reference numerals, increased by 100. The main differences are that the recesses 162 are more numerous than recesses 62, the vanes 186 are thinner than vanes 86, and the air inlet ports 124 are more numerous, although smaller, than the air inlet ports 24. For convenience, the cone connected to the upper end of the burn pot is not shown in FIG. 5.

Figure 7:
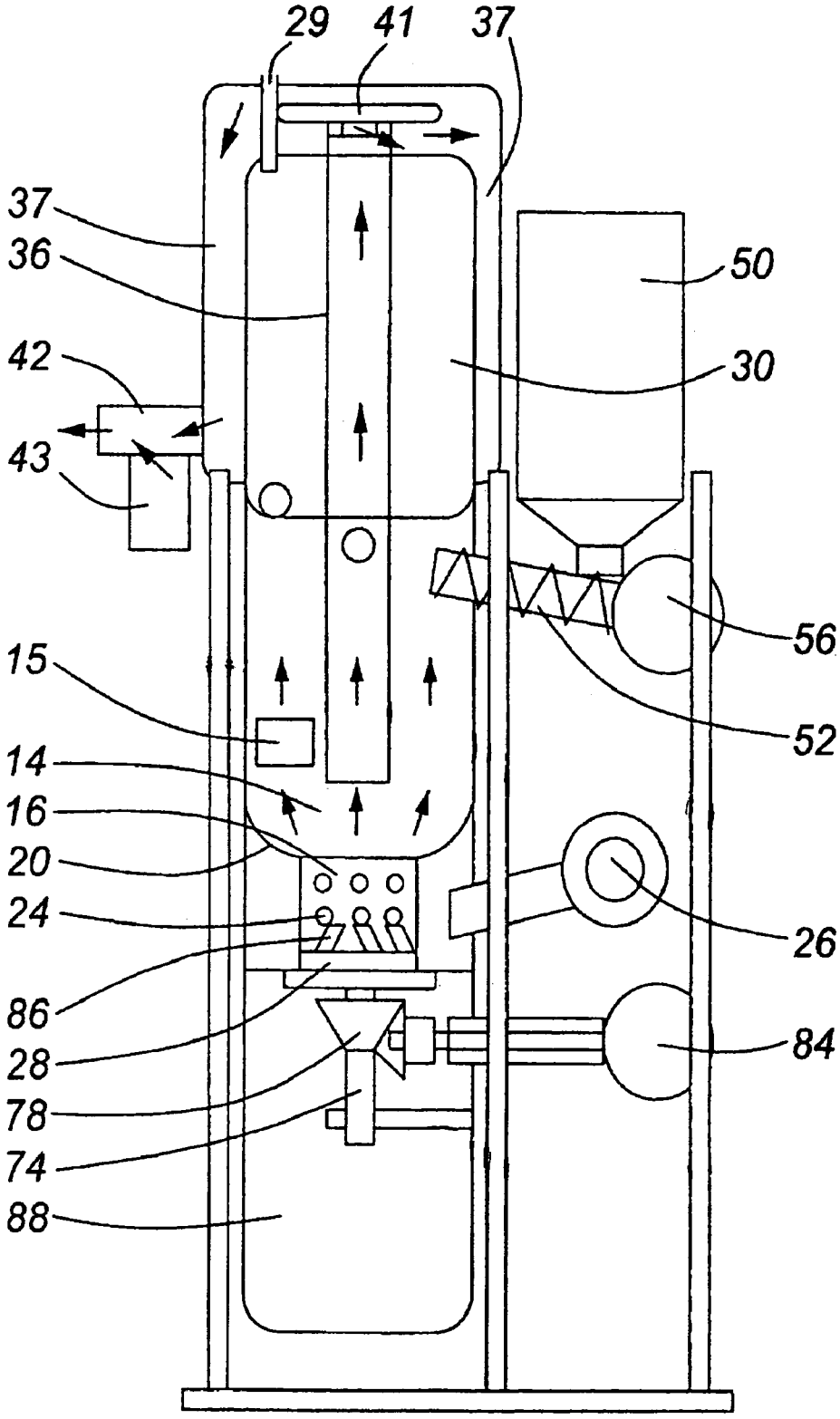
FIG. 7 is a view similar to FIG. 1 of a further modified burner.

With reference to FIG. 7, a further embodiment of the present invention is illustrated similar to the previously described embodiments of the present invention, in this embodiment, a chimney 36 leading upwardly from the combustion chamber 14 passes up through the center of a water chamber 30 and conducts hot flue gases out of the combustion chamber while heating the water in chamber 30. The flue gases then pass a deflector plate 41 which redirects and distributes the flue gases into an exhaust jacket 37 surrounding the outside of the water chamber 30, the flue gases within the exhaust jacket 37 further heating the water in the chamber 30 before the flue gases pass out of a side outlet 42, the fly ash being downwardly directed as it passes through the side outlet 42 by a deflector plate 45, the fly ash thereafter exiting through a fly ash passage 43 for collection and disposal. Water may be added or removed (or pressure relieved) from the water chamber 30 by way of an opening 29 in the top of the water chamber 30. An access doorway 15 is provided to light and monitor the fire.

A further embodiment of the burner, not shown, may be in the form of a space heater. In this case, either air may be blown over the exterior of the water chamber 30, or the air may be blown through a chamber, similar to chamber 30, with appropriate venting in both cases.

It is understood that combustion catalysts, such as COMATE® (available, for example from ATLANTIC COMBUSTION TECHNOLOGIES, INC. in Mulgrave, Nova Scotia, Canada) may be added to the hay pellets to reduce the formation of clinkers, or alternatively, to soften the clinkers that may be formed during the combustion process.

The present invention has been described herein with regard to preferred embodiments. However, it will be obvious to persons skilled in the art that a number of variations and modifications can be made without departing from the scope of the invention as described herein.

What is claimed is:

1. A burner for fuel in pellet or granular form comprising:

a combustion chamber having an unperforated grate at its lower end;

means for feeding said fuel into said combustion chamber;

means for supplying air to the combustion chamber;

a hot gas outlet for exhausting combustion gases from said combustion chamber; and means for transferring heat from said combustion chamber and/or said hot gas outlet to air or other fluid to be heated;

wherein said grate is provided with a rotary member adapted to continually move ash or clinker on said grate through outlet apertures spaced around said grate, wherein said grate is generally horizontal, and wherein said rotary member rotates on a vertical shaft;

wherein said grate includes a generally planar surface provided with recesses over which said rotary member passes, the rotary member and recesses being such that ash or clinker particles may be broken into smaller particles by engagement of said particles in said recesses as the rotary member passes over the recesses and fragments the particles.

2. A burner according to claim 1, wherein said grate is surrounded by a cylindrical wall, and wherein said outlet apertures of the grate are spaced around outer edges of said grate near said cylindrical wall.

3. A burner according to claim 2, wherein said vertical shaft is rotated by a horizontal-axis motor via a bevel gear.

4. A burner according to claim 2, wherein said rotary member includes a generally horizontal bar mounted on a vertical shaft, and flutes projecting upwardly from said bar and angled to the bar in such way as to move ash outwardly towards the outlet apertures as the bar rotates.

5. A burner according to claim 2, wherein said means for supplying air comprises a plurality of air apertures disposed in the cylindrical wall a predetermined distance above the grate.

6. A burner according to claim 5, wherein said air apertures are disposed such that the fuel burns while floating on top of the ash.

7. A burner according to claim 5, wherein said rotary member includes a generally horizontal bar mounted on a vertical shaft, and flutes projecting upwardly from said bar and angled to the bar in such way as to move ash outwardly towards the outlet apertures as the bar rotates, and wherein said air apertures are disposed in proximity to an upper end portion of the flutes.

8. A burner according to claim 1, wherein said rotary member includes a generally horizontal bar mounted on a vertical shaft, and flutes projecting upwardly from said bar and angled to the bar in such way as to move ash outwardly towards the outlet apertures as the bar rotates.

9. A burner according to claim 8, wherein said cylindrical wall is provided with a door through which large ash or clinker particles can be expelled by the rotary member.

* * * * *